US007828665B2

(12) United States Patent
Chuang et al.

(10) Patent No.: US 7,828,665 B2
(45) Date of Patent: Nov. 9, 2010

(54) RODEO OR RIDING DEVICE

(76) Inventors: Jin Chen Chuang, No. 17, Lane 301, Nanyang Road, Fong Yuan, Taichung Hsien 42083 (TW); Lung Fei Chuang, No. 17, Lane 301, Nanyang Road, Fong Yuan, Taichung Hsien 42083 (TW)

( * ) Notice: Subject to any disclaimer, the term of this patent is extended or adjusted under 35 U.S.C. 154(b) by 438 days.

(21) Appl. No.: 12/148,938

(22) Filed: Apr. 22, 2008

(65) Prior Publication Data

US 2008/0200271 A1 Aug. 21, 2008

Related U.S. Application Data

(63) Continuation-in-part of application No. 11/654,732, filed on Jan. 17, 2007.

(51) Int. Cl.
*A63G 13/06* (2006.01)
*A63B 69/16* (2006.01)

(52) U.S. Cl. ..... 472/95; 472/101; 472/135; 434/247; 482/52

(58) Field of Classification Search ..... 472/95–101, 472/130, 131, 135; 434/29, 55, 61, 62, 247, 434/256; 482/51, 52, 54
See application file for complete search history.

(56) References Cited

U.S. PATENT DOCUMENTS

| | | | | |
|---|---|---|---|---|
| 3,997,979 | A | 12/1976 | Turner | 35/29 R |
| 5,085,425 | A | 2/1992 | Collins et al. | 272/53.1 |
| 5,180,338 | A * | 1/1993 | Pinto | 472/96 |
| 6,217,486 | B1 * | 4/2001 | Rosenow | 482/52 |
| 6,402,626 | B1 | 6/2002 | Beaty | 472/96 |
| 6,719,666 | B1 * | 4/2004 | Lo et al. | 482/52 |
| 6,808,458 | B1 * | 10/2004 | Jung | 472/97 |
| 6,866,594 | B2 | 3/2005 | Greenwood | 473/422 |
| 6,964,614 | B1 | 11/2005 | Tsai | 472/58 |
| 7,338,413 | B2 * | 3/2008 | Nakanishi | 482/51 |

* cited by examiner

*Primary Examiner*—Kien T Nguyen
(74) *Attorney, Agent, or Firm*—Charles E. Baxley

(57) ABSTRACT

A riding device includes a crank device rotatably attached to a base, and a rider support supported on a carrier and movable relative to the base for supporting a rider, the carrier has a front portion pivotally coupled to the base and a rear portion coupled to the cranks for moving cyclically relative to the base and for allowing the carrier to be moved in an elliptical and reciprocating action relative to the base by the crank device, and a motor or motorized rotating device for rotating the crank device relative to the base in the cyclic and reciprocating action to actuate the carrier and the rider support to move relative to the base in an elliptical and reciprocating action.

10 Claims, 6 Drawing Sheets

RODEO OR RIDING DEVICE

The present invention is a continuation-in-part of U.S. patent application Ser. No. 11/654,732, filed 17 Jan. 2007, pending.

BACKGROUND OF THE INVENTION

1. Field of the Invention

The present invention relates to a rodeo or riding device, and more particularly to a rodeo or riding device including a rider support or saddle supported on a carrier which is movable relative to a base by the user or rider or by an actuating device in an elliptical and reciprocating action for allowing the rider support and the rider also to be moved relative to the base in the elliptical and reciprocating action.

2. Description of the Prior Art

Typical riding devices or rodeo training devices comprise a rider support for supporting the users thereon, and a drive mechanism having a crank arm coupled to the rider support to drive the rider support and to simulate the bucking and/or spinning motions of a rodeo animal attempting to unseat its rider.

For example, U.S. Pat. No. 3,997,979 to Turner discloses one of the typical rodeo training devices also comprising a drive mechanism coupled to the rider support with a crank arm for training cowboys to ride rodeo animals such as bulls and wild horses.

Normally, the drive mechanism is coupled to the rider support with the crank arm for actuating or moving or rotating the rider support. In addition, the drive mechanism is solidly coupled to the rider support with the crank arm, such that the rider support may not be moved relative to the crank arm and the drive mechanism in an elliptical and reciprocating action and also may not be moved relative to the crank arm and the drive mechanism in different moving stroke.

U.S. Pat. No. 5,085,425 to Collins et al. discloses a typical workout horse comprising a body portion having a support column extended downwardly therefrom, and an upper frame attached to the support column, and a drive mechanism coupled between the upper frame and a stationary base frame for actuating or moving the support column and the body portion relative to the stationary base frame.

However, the support column and the body portion may not be moved relative to the stationary base frame in an elliptical and reciprocating action. In addition, the drive mechanism is also solidly coupled between the upper frame and the stationary base frame such that the support column and the body portion also may not be moved relative to the stationary base frame in an elliptical and reciprocating action and also may not be moved relative to the stationary base frame in different moving stroke.

U.S. Pat. No. 6,402,626 to Beaty discloses a typical bucking machine also comprising a drive mechanism coupled to the rider support with one or more crank arms and/or links and/or spin wheels and/or spin shafts, and a rotating frame for supporting the rider support for allowing the rider support to be driven to simulate the bucking and/or spinning motions of a rodeo animal attempting to unseat its rider.

However, the rotating frame may only be rotated relative to the stationary base frame but not be moved relative to the stationary base frame in an elliptical and reciprocating action and also may not be moved relative to the stationary base frame in different moving stroke.

U.S. Pat. No. 6,866,594 to Greenwood discloses a typical polo training apparatus comprising a body portion having a lower frame portion, and a drive mechanism coupled between the lower frame portion of the body portion and a fixed frame for driving the lower frame portion of the body portion to simulate the polo training operation.

However, the fixed frame and the lower frame portion of the body portion may not be moved relative to the supporting ground or plane in an elliptical and reciprocating action and also may not be moved relative to the cranks and the swing arms of the drive mechanism in different moving stroke.

U.S. Pat. No. 6,964,614 to Tsai discloses a typical riding device also comprising a seat plate coupled to a front spindle and a rear spindle of a drive mechanism with cranks and swing arms respectively, for driving the seat plate to simulate the bucking and/or spinning motions of a rodeo animal attempting to unseat its rider.

However, the seat plate is also solidly coupled to the drive mechanism with the cranks and the swing arms, such that the seat plate may not be moved relative to the cranks and the swing arms of the drive mechanism in an elliptical and reciprocating action and also may not be moved relative to the cranks and the swing arms of the drive mechanism in different moving stroke.

The present invention has arisen to mitigate and/or obviate the afore-described disadvantages of the conventional bucking or riding or rodeo training devices.

SUMMARY OF THE INVENTION

The primary objective of the present invention is to provide a rodeo or riding device including a rider support or saddle supported on a carrier which is movable relative to a base by the user or rider or by a motorized actuating or driving or moving device in an elliptical and reciprocating action for allowing the rider support also to be moved relative to the base in the elliptical and reciprocating action.

In accordance with one aspect of the invention, there is provided a riding device comprising a base including a column and a stud extended upwardly from the base, a crank device rotatably attached to the stud of the base with an axle and rotatable relative to the base in a cyclic and reciprocating action, a carrier including a front portion pivotally coupled to the column of the base for swinging relative to the base, and including a rear portion pivotally coupled to the crank device for moving cyclically relative to the base and for allowing the carrier to be moved in an elliptical and reciprocating action relative to the base by the crank device, a rider support supported on the carrier and moved in concert with the rider support for supporting a rider, and the carrier and the rider support being movable relative to the base in an elliptical and reciprocating action by the rider, and a motorized rotating device for driving or rotating the crank device relative to the base in the cyclic and reciprocating action in order to actuate the carrier and the rider support to move relative to the base in an elliptical and reciprocating action and for allowing the rider to conduct a riding or rodeo exercise.

The rotating device includes a driving device coupled to the crank device for rotating the crank device relative to the base. The driving device includes a motor for rotating the crank device relative to the base. The carrier includes a housing for supporting the rider support.

The driving device includes a fly wheel rotatably attached to the base and coupled to the crank device and rotated in concert with the crank device, and a pulley rotatably attached to the base and coupled to the fly wheel, and the motor is coupled to the pulley for rotating the pulley and the fly wheel and the crank device relative to the base.

The base includes an arm pivotally coupled to the column of the base with a pivot pin, and a link pivotally coupled to the arm with a pivot pole, the front portion of the carrier is pivotally coupled to the link which is pivotally coupled to the arm. The pivot pole is spaced from the pivot pin.

The crank device is coupled to the arm with an actuating lever for actuating or moving the arm in a reciprocating action relative to the column of the base. The actuating lever is coupled to the arm with a pivot rod which is preferably spaced from the pivot pin and the pivot pole.

The rear portion of the carrier is pivotally coupled to the crank device with a pendulum for allowing the rear portion of the carrier to be swung relative to the base.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
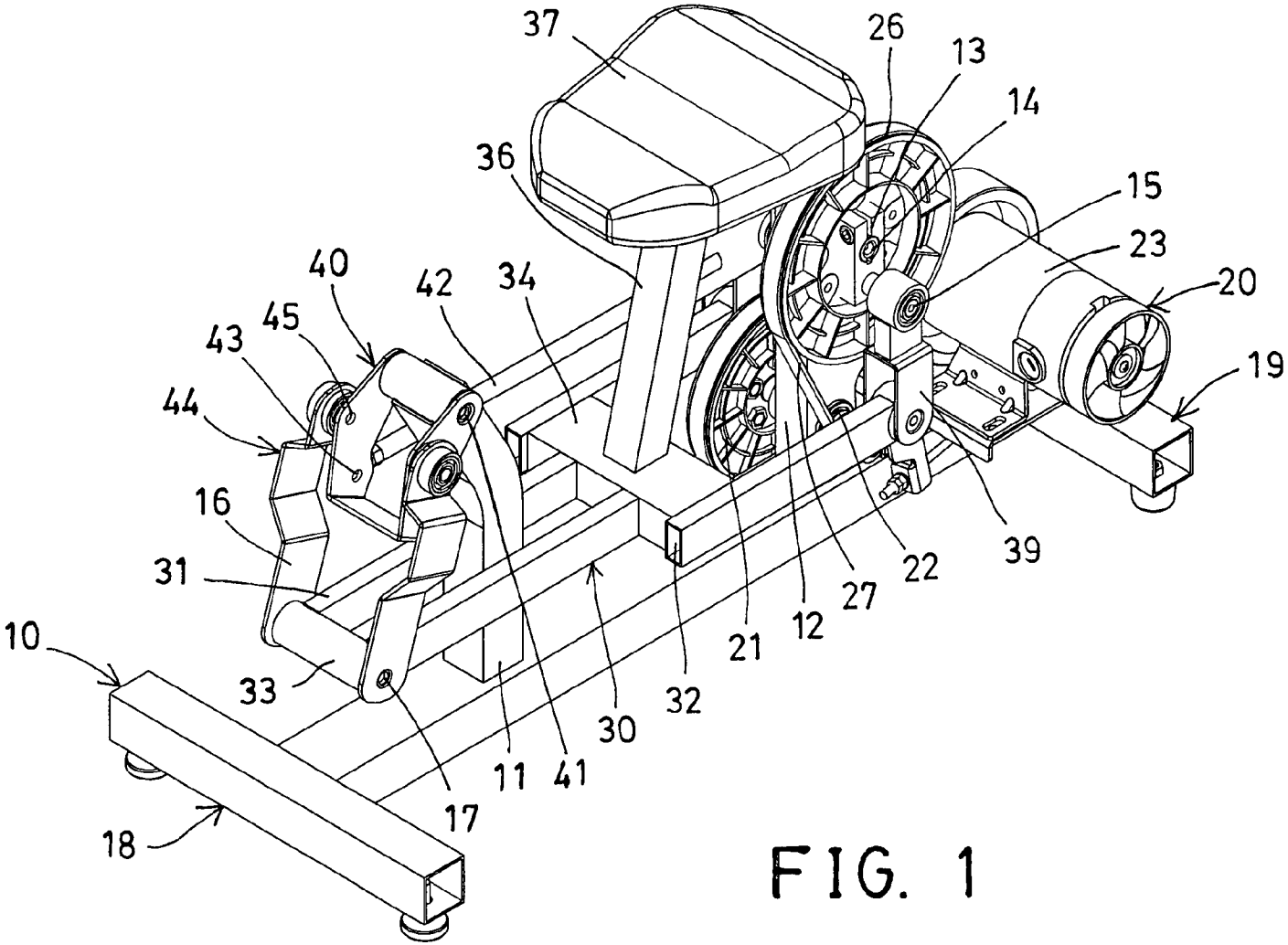
FIG. 1 is a front and upper perspective view of a riding device in accordance with the present invention.
Figure 2:
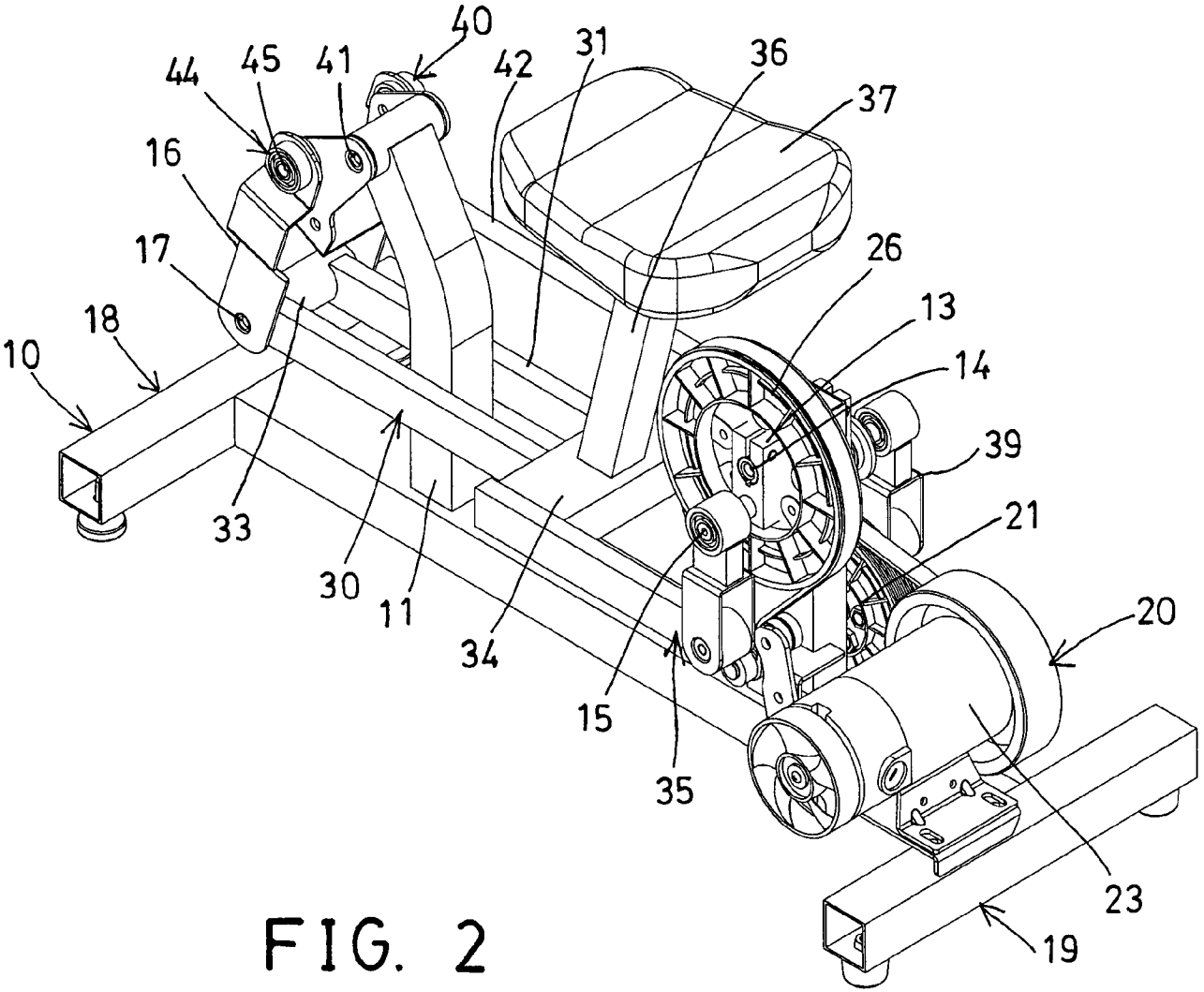
FIG. 2 is a rear and upper perspective view of the riding device.
Figure 3:
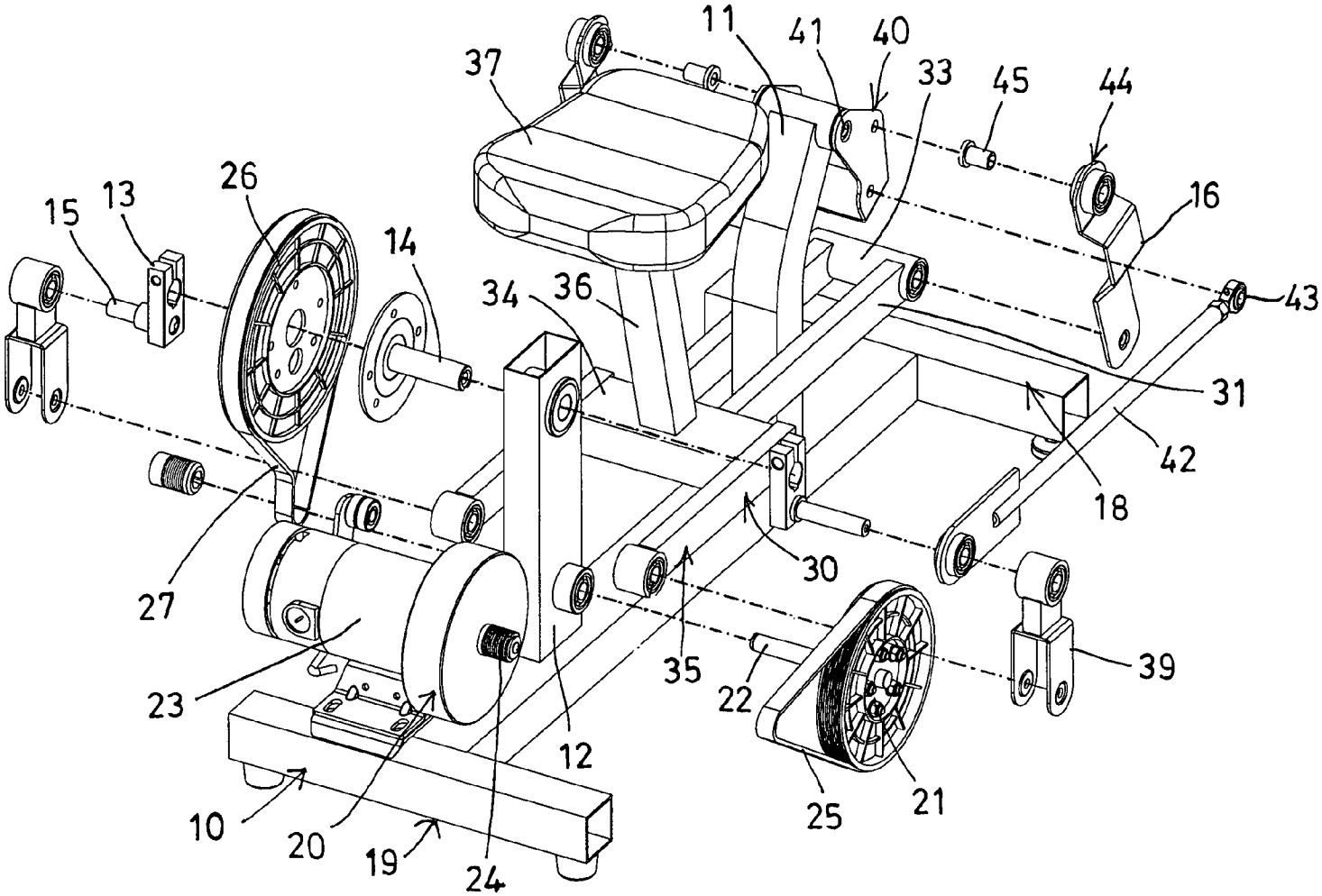
FIG. 3 is a partial exploded view of the riding device.
Figure 4:
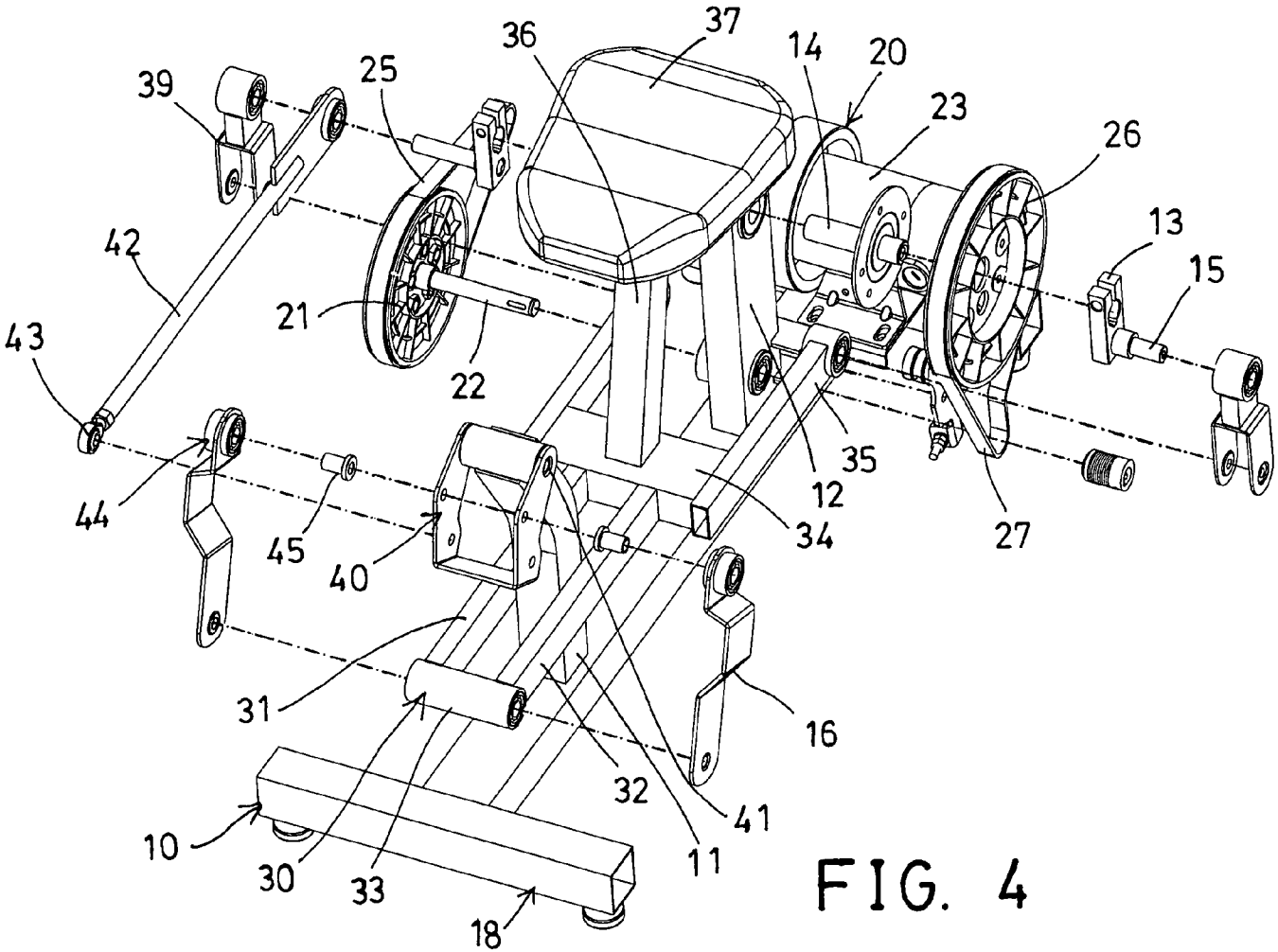
FIG. 4 is another partial exploded view of the riding device.

Referring to the drawings, and initially to FIGS. 1-5, a riding device in accordance with the present invention comprises a stationary base 10 including such as an I-shaped structure for increasing the stability of the base 10, and including a column 11 extended upwardly therefrom, such as extended upwardly from one end or the front portion 18 of the base 10, and including a stud 12 extended upwardly therefrom, such as extended upwardly from the other end or the rear portion 19 of the base 10, and including a crank device 13 or one or more (such as two) cranks 13 rotatably attached to or supported on the base 10, such as rotatably attached to the stud 12 with an axle 14 and rotatable relative to the base 10 in a cyclic and reciprocating action. A bearing or pivot pole 15 is attached to the free end portion of each of the cranks 13.

Figure 5:
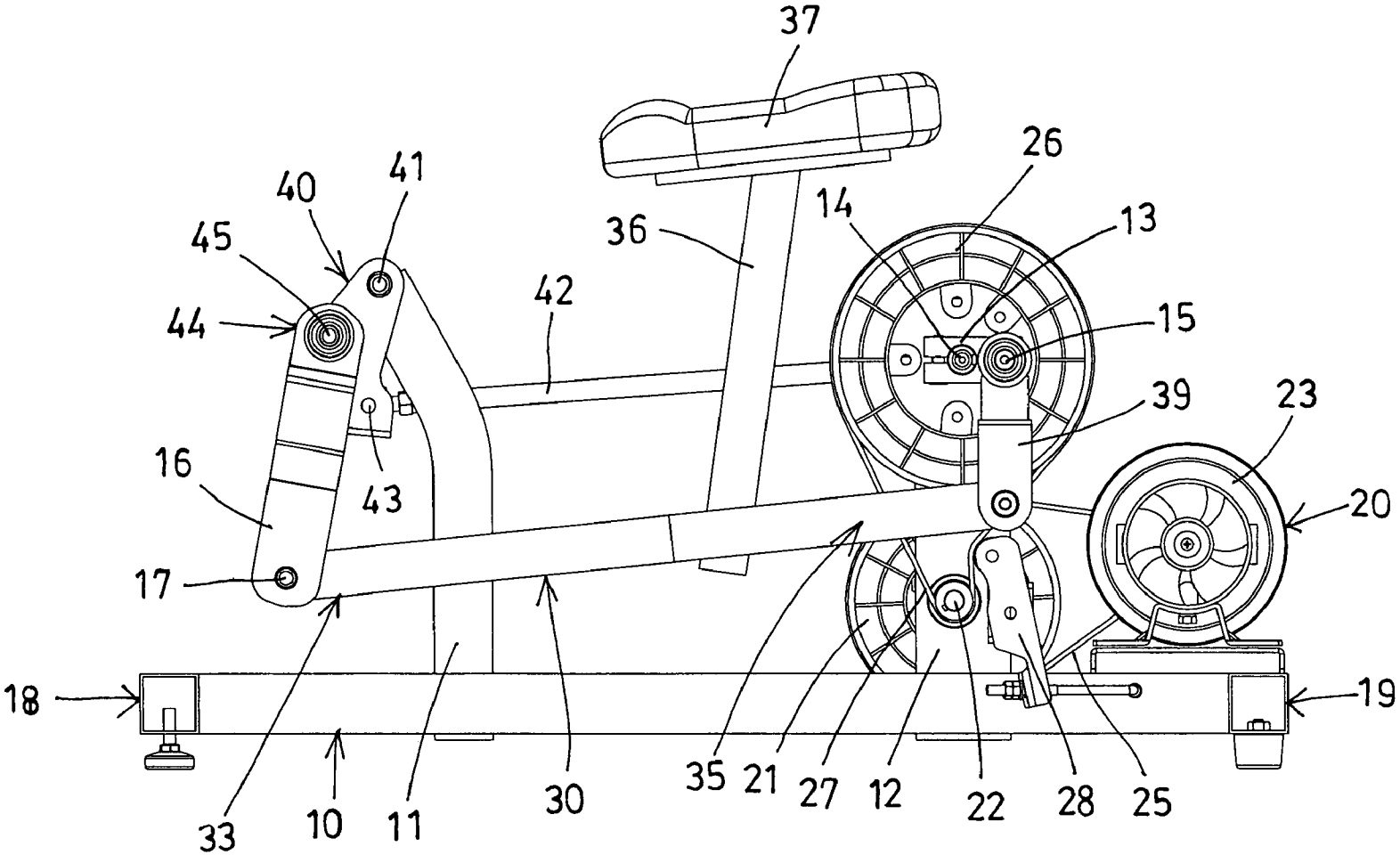
FIG. 5 is a side plan schematic view of the riding device.
Figure 6:
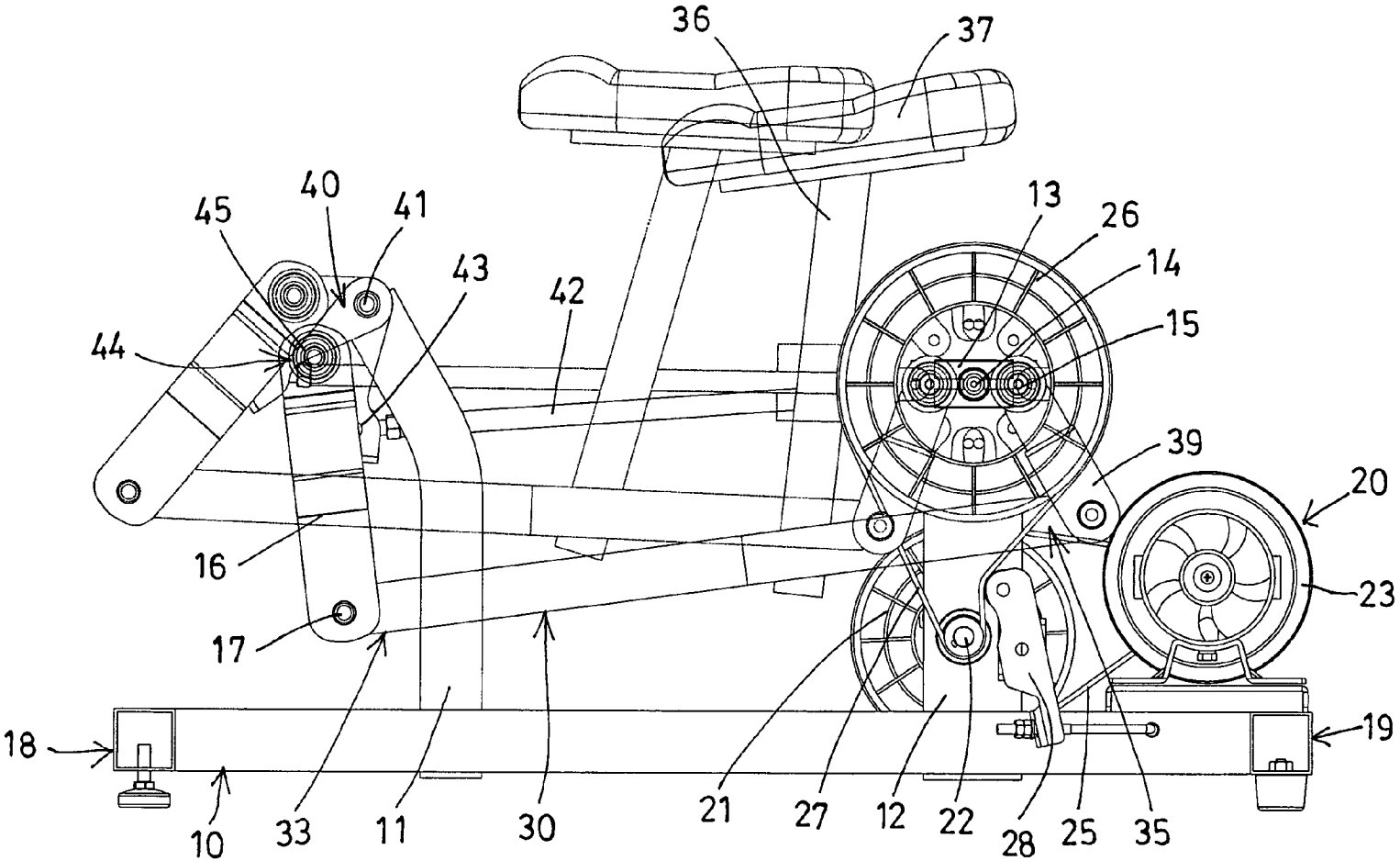
FIG. 6 is a side plan schematic view similar to FIG. 5, illustrating the operation of the riding device.

A carrier 30 is to be supported on the base 10 and is to be moved relative to the base 10 in an elliptical and reciprocating action, and includes one or more (such as two) levers 31, 32 having one end or a front portion coupled together with a front barrel 33 which is pivotally coupled to the base 10, such as pivotally coupled to the one end or the front portion or the front column 11 of the base 10 with a pivotal link 16 and a pivot pin 17, in which the pivotal link 16 may be directly or indirectly coupled to the front column 11 of the base 10 for allowing the one end or the front portion or the front barrel 33 of the carrier 30 to be pivoted or rotated relative to the front column 11 of the base 10 and to be moved forwardly and rearwardly relative to the base 10 in a reciprocating action, best shown in FIGS. 5-6. It is preferable that the carrier 30 includes a bar 34 coupled between the middle portion of the levers 31, 32 for forming a stable or solid structure to the carrier 30.

The carrier 30 includes a rear end or rear portion 35 pivotally coupled to the pivot poles 15 of the cranks 13 directly or indirectly with a pendulum 39 for allowing the rear portion 35 of the carrier 30 to be moved forwardly and rearwardly and upwardly and downwardly or cyclically relative to the base 10 by or with the cranks 13 (FIGS. 5-6) and also to be swung relative to the cranks 13 and the base 10 with the pendulum 39. A housing 36 is disposed on the carrier 30, such as attached to or disposed on the bar 34 of the carrier 30 and extended upwardly from the bar 34 of the carrier 30 for supporting a seat cushion or saddle or rider support 37 thereon in order to support a user or rider on the rider support 37. For example, the rider support 37 may include a telescopic or a retractable structure adjustable up and down relative to the housing 36 and the carrier 30, and adjustably secured to the housing 36 and/or the carrier 30 with a lock or latch device (not shown) or the like.

In operation, as shown in FIGS. 5-6, the rear portion 35 of the levers 31, 32 or the carrier 30 may be moved forwardly and rearwardly and upwardly and downwardly or cyclically relative to the base 10 in the reciprocating action with the pivot poles 15 or the cranks 13, and may also be moved or swung forwardly and rearwardly relative to the base 10 in the reciprocating action with the pendulum 39, and the one end or front portion or the front barrel 33 of the carrier 30 is pivotally coupled to the base 10 with the pivotal link 16 and the pivot pin 17 for allowing the front portion or the front barrel 33 of the carrier 30 to be moved forwardly and rearwardly or to be swung relative to the base 10 in the reciprocating action such that the carrier 30 may be caused to move relative to the base 10 in an elliptical and reciprocating action by the cranks 13 and by the user or rider, and/or by the moment of inertia when the users or riders are stepped onto the carrier 30. The rider support 37 may be moved or adjusted up and down along the housing 36 and relative to the carrier 30 according to the different heights of the users or riders.

A motor driving or rotating means or device 20 is disposed on the base 10 and is provided for coupling to the cranks 13 in order to rotate the cranks 13 relative to the base 10 in the cyclic and reciprocating action, and includes a wheel or pulley 21 rotatably attached to the base 10, such as rotatably attached to the stud 12 of the base 10 with a shaft 22, and includes a motor 23 disposed on the base 10 and having a spindle 24 (FIG. 3) coupled to the pulley 21 with a coupling device 25, such as a coupling belt 25, a gearing mechanism (not shown), a sprocket-and-chain mechanism (not shown) or the like for rotating or driving the pulley 21 relative to the base 10 or the stud 12, and includes a weight member or fly wheel 26 also rotatably attached to the base 10, such as rotatably attached to the stud 12 of the base 10 with the axle 14 for allowing the axle 14 and the cranks 13 and the fly wheel 26 to be rotated in concert with each other.

The weight member or fly wheel 26 is coupled to the pulley 21, such as coupled to the shaft 22 of the pulley 21 with another coupling device 27 (FIGS. 5-6), such as a coupling belt 27, a gearing mechanism (not shown), a sprocket-and-chain mechanism (not shown) or the like for allowing the pulley 21 to be indirectly coupled to the motor 23 with the pulley 21 and for allowing the pulley 21 and thus the cranks 13 to be driven or rotated relative to the base 10 or the stud 12 by the motor 23. The coupling of the fly wheel 26 to the pulley 21 may thus be formed or acted as a speed reduction mechanism. Alternatively, the fly wheel 26 or the cranks 13 may also be directly coupled to the motor 23 with another coupling device (not shown) without the fly wheel 26 and the pulley 21. A brake device 28 may be provided and engaged with the coupling device 27 for braking the fly wheel 26 of the motor driving or rotating means or device 20.

In operation, as shown in FIGS. 5-6, the levers 31, 32 or the carrier 30 may be moved forwardly and rearwardly relative to the base 10 in the reciprocating action by the cranks 13, and the one end or front portion or the front coupling member 33 of the carrier 30 is pivotally coupled to the base 10 with the pivotal link 16 such that the carrier 30 may be caused to move relative to the base 10 in an elliptical and reciprocating action by the cranks 13 and the motor 23. The cranks 13 and the motor 23 and/or the levers 31, 32 or the carrier 30 may thus be formed or acted as a moving means or device for moving the carrier 30 relative to the base 10 in the elliptical and reciprocating action. The typical riding devices or rodeo training devices failed to provide and dispose a saddle or rider support 37 on the carrier 30 for supporting the user or the rider, and a motor driving or rotating means or device 20 provided for moving the carrier 30 relative to the base 10 in an elliptical and reciprocating action.

An arm 40 may further be provided and pivotally coupled to the one end or the front portion or the front column 11 of the base 10 with another pivot pin 41, and the pivotal link 16 has an upper portion 44 pivotally coupled to the arm 40 with a pivot pole 45 which is spaced from the pivot pin 41, and an actuating lever 42 coupled to one of the cranks 13 and coupled to the arm 40 with a pivot rod 43 which is spaced from the pivot pin 41 and the pivot pole 45, and the pivot pole 45 is preferably disposed between the pivot pin 41 and the pivot rod 43, such that the arm 40 may be forced or actuated to move in a reciprocating action relative to the front column 11 or the base 10 by the cranks 13, and the pivot pole 45 or the upper portion 44 of the pivotal link 16 may be forced or actuated to move in a curved moving stroke around the pivot pin 41 and thus may be forced or actuated to move up and down relative to the front column 11 or the base 10 for allowing the carrier 30 and the rider support 37 to be moved in a changing or increased or different moving strokes.

It is to be noted that the pivotal link 16 may also be directly and pivotally coupled to the front column 11 of the base 10 and may only be swung relative to the front column 11 or the base 10, but may not be moved up and down relative to the front column 11 or the base 10. The pivotal coupling of the upper portion 44 of the pivotal link 16 to the arm 40 with the pivot pole 45 allows the pivot pole 45 or the upper portion 44 of the pivotal link 16 to be forced or actuated to move up and down relative to the front column 11 or the base 10 and allows the rider support 37 to be moved in the changing or increased or different moving strokes.

Accordingly, the riding device in accordance with the present invention includes a rider support supported on a carrier which is movable relative to a base by the user or rider or by an actuating device in an elliptical and reciprocating action for allowing the rider support also to be moved relative to the base in the elliptical and reciprocating action.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A riding device comprising:

a base including a column and a stud extended upwardly from said base, a crank device rotatably attached to said stud of said base with an axle and rotatable relative to said base in a cyclic and reciprocating action, a carrier including a front portion pivotally coupled to said column of said base for swinging relative to said base, and including a rear portion pivotally coupled to said crank device for moving cyclically relative to said base and for allowing said carrier to be moved in an elliptical and reciprocating action relative to said base by said crank device, a rider support supported on said carrier and moved in concert with said rider support for supporting a rider, and said carrier and said rider support being movable relative to said base in an elliptical and reciprocating action by the rider, and means for rotating said crank device relative to said base in the cyclic and reciprocating action to actuate said carrier and said rider support to move relative to said base in an elliptical and reciprocating action.

2. The riding device as claimed in claim 1, wherein said rotating means includes a driving device coupled to said crank device for rotating said crank device relative to said base.

3. The riding device as claimed in claim 2, wherein said driving device includes a motor for rotating said crank device relative to said base.

4. The riding device as claimed in claim 3, wherein said driving device includes a fly wheel rotatably attached to said base and coupled to said crank device and rotated in concert with said crank device, and a pulley rotatably attached to said base and coupled to said flywheel, and said motor is coupled to said pulley for rotating said pulley and said fly wheel and said crank device relative to said base.

5. The riding device as claimed in claim 1, wherein said carrier includes a housing for supporting said rider support.

6. The riding device as claimed in claim 1, wherein said base includes an arm pivotally coupled to said column of said base with a pivot pin, and a link pivotally coupled to said arm with a pivot pole, said front portion of said carrier is pivotally coupled to said link.

7. The riding device as claimed in claim 6, wherein said pivot pole is spaced from said pivot pin.

8. The riding device as claimed in claim 6, wherein said crank device is coupled to said arm with an actuating lever for moving said arm in a reciprocating action relative to said column of said base.

9. The riding device as claimed in claim 8, wherein said actuating lever is coupled to said arm with a pivot rod which is spaced from said pivot pin and said pivot pole.

10. The riding device as claimed in claim 1, wherein said rear portion of said carrier is pivotally coupled to said crank device with a pendulum for allowing said rear portion of said carrier to be swung relative to said base.

* * * * *